United States Patent [19]

McGowan et al.

[11] Patent Number: 4,861,293

[45] Date of Patent: Aug. 29, 1989

[54] MARINE PROPULSION DEVICE WITH SCREENED WATER INLET

[75] Inventors: Philip J. McGowan, Grayslake; Steven R. McNeill, Waukegan; Matthew H. Mondek, Wonder Lake; James A. Mahnich, Lake Villa, all of Ill.

[73] Assignee: Outboard Marine Corporation, Waukegan, Ill.

[21] Appl. No.: 183,842

[22] Filed: Apr. 20, 1988

[51] Int. Cl.[4] ..... B53H 21/26

[52] U.S. Cl. ..... 440/76; 440/88

[58] Field of Search ..... 440/88, 89, 76, 78

[56] References Cited

U.S. PATENT DOCUMENTS

| | | | |
|---|---|---|---|
| 1,762,957 | 6/1930 | Buehner . | |
| 2,507,034 | 5/1950 | Martin | 115/17 |
| 2,616,386 | 11/1952 | Kiekhaefer | 115/17 |
| 2,847,967 | 8/1958 | Kiekhaefer | 115/18 |
| 3,181,495 | 5/1965 | Kiekhaefer | 115/34 |
| 4,033,282 | 7/1977 | Pichl | 115/17 |
| 4,636,175 | 1/1987 | Frazzell | 440/88 |
| 4,752,257 | 6/1988 | Karls et al. | 440/88 |

FOREIGN PATENT DOCUMENTS

| | | | |
|---|---|---|---|
| 0030691 | 2/1982 | Japan | 440/88 |

*Primary Examiner*—Sherman D. Basinger

*Attorney, Agent, or Firm*—Michael, Best & Friedrich

[57] ABSTRACT

Disclosed herein is a marine propulsion device comprising a lower unit including a gear case rotatably supporting a propeller shaft adapted to support a propeller, which gear case includes an interior passage leading to a water pump, which gear case also includes a leading edge and opposite side surfaces having outwardly convex configurations extending rearwardly from the leading edge, one of the side surfaces including a cooling water inlet comprising an opening located in the one side surface, communicating with the interior passage, and defined by forward and rearward walls, a recess located in the one side surface forwardly of the opening and having a rearward end located at the forward wall of the opening and a forward end, which recess increases in lateral depth from the forward end to the rearward end, and a screen located in the opening and including an inclined portion extending outwardly and rearwardly from the forward wall of the opening, and a side portion extending rearwardly from the inclined portion to the rearward wall of the opening, which screen also includes a series of horizontal parallel slots located in the inclined and side portions and affording inflow of cooling water to the passage.

9 Claims, 1 Drawing Sheet

MARINE PROPULSION DEVICE WITH SCREENED WATER INLET

BACKGROUND OF THE INVENTION

The invention relates generally to marine propulsion devices such as outboard motors and stern drive units.

Still more particularly, the invention relates to cooling water inlets in the gear case of such marine propulsion devices and to screened cooling water inlets for marine Propulsion devices.

Attention is directed to the following prior art United States Patents:

| | | |
|---|---|---|
| Buehner | 1,762,957 | June 10, 1930 |
| Martin | 2,507,034 | May 9, 1950 |
| Kiekhaefer | 2,616,386 | November 4, 1952 |
| Kiekhaefer | 2,847,967 | August 19, 1958 |
| Kiekhaefer | 3,181,495 | May 4, 1965 |
| Pichl | 4,033,282 | July 5, 1977 |
| Frazzell | 4,636,175 | January 13, 1987 |

SUMMARY OF THE INVENTION

The invention provides a marine propulsion device comprising a lower unit including a gear case rotably supporting a propeller shaft adapted to support a propeller, which gear case includes an interior passage leading to a water pump, which gear case also includes a leading edge and apposite side surfaces having outwardly convex configurations extending rearwardly from the leading edge, one of the side surfaces including a cooling water inlet comprising means defining an opening located in the one side surface, communicating with the interior passage, and having forward and rearward walls, a recess located in the one side surface forwardly of the opening and having a rearward end located at the forward wall of the opening and a forward end, which recess increases in lateral depth from the forward end to the rearward end, and a screen located in the opening and including an inclined portion extending outwardly and rearwardly from the forward wall o the opening, and a side portion extending rearwardly from the inclined portion to the rearward wall of the opening, which screen also includes a series of horizontal parallel slots located in the inclined and side portions and affording inflow of cooling water to the passage.

The invention also provides a screen for a water inlet opening in an outer side surface of a gear case included in a marine propulsion device, which opening has forward and rearward walls, which screen is adapted to be located in the opening and comprises a first portion having one end adapted to extend outwardly and rearwardly from the forward wall of the opening, and having an other end, which screen also comprises a second portion extending from said other end of said first portion and at an obtuse angle thereto and adapted to extend to the rearward wall of the opening, which screen also comprises a series of horizontal Parallel slots located in the first and second portions and affording inflow of cooling water into the opening.

Other features and advantages of the n will become apparent to those skilled in the art upon review of the following detailed description, claims, and drawings.

Figure 1:
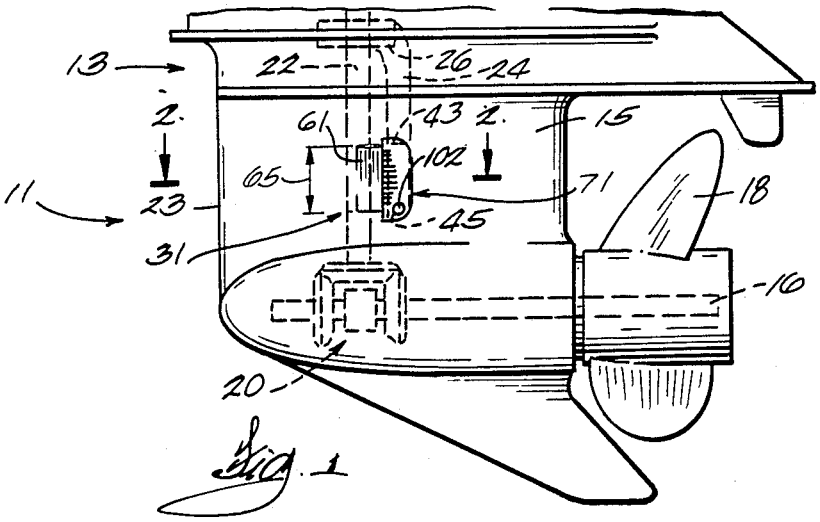
FIG. 1 is a fragmentary side elevational view of a portion of lower unit of a marine propulsion device which incorporates various of the features of the invention.

Before one embodiment of the invention is explained in detail, it is to be understood that the invention is not limited in its application to the details of the construction and the arrangements of components set forth in the following description or illustrated in the drawings. The invention is capable of other embodiments and of being Practiced or being carried out in various ways. Also, it is to be understood that the phraseology and terminology used herein is for the purpose of description and should not be regarded as limiting.

GENERAL DESCRIPTION

As shown in FIG. 1 of the drawings is a portion of a lower unit 11 of a marine propulsion device 13 which can either be an outboard motor or a stern drive unit. The portion of the lower unit 11 shown in FIG. 1 comprises a gear case 15 which supports a propeller shaft 16 carrying a Propeller 18 and connected via a reversing transmission 20 with a drive shaft 22 driven by an engine (not shown). The gear case 15 is generally symmetrical on each side of a center line 17 which divides the gear case into left and right half sections 19 and 21 and which includes a leading edge 23. Each of the half sections 19 and 21 includes a side surface 25 which extends rearwardly from the leading edge 23 and which is outwardly convex toward a maximum dimension 27 transversely of, or perpendicularly to, the center line 17.

The gear case 15 also includes an interior hollow conduct or passage 24 leading to the intake of a water pump 26 for supplying cooling water to the engine of the marine propulsion device 13. The conduct or Passage 24 includes, in each of the half sections 19 and 21, respective branch passages or openings 51 which open in the gear case side surfaces 25 and which, in part, form a screened water inlet 31.

As the construction is identical (except for being left and right handed) in both half sections 19 and 21, only the opening 51 in the half section 19 will be described. In this regard, the opening 51 is defined by vertically extending forward and rearward walls 39 and 41, respectively, which slightly converge inwardly, as well as by upper and lower inwardly extending walls 43 and 45, respectively. The rearward wall 41 forming the opening 51 includes, throughout the vertical height thereof, and adjacent the side surface 25, a recess 53 which will be hereinafter referred to.

Extending forwardly in the side surface 25 of the gear case 15 from the forward wall 39 of the opening 51, and forming a part of the water inlet 31, is a ramp or recess 61 which has a forward vertical edge 63 in the convexly configured outer side surface 25 and which increases in lateral or horizontal dimension from the forward edge 25 to the forward wall 39 of the opening 51. The ramp 61 has a vertical height 65 approximately equal to the height of the opening 51.

Located in the opening 51, and forming a part of the water inlet 31, is a screen 71 which is fabricated from plastic and which includes a first or transverse or forward portion 73 engaging the forward wall 39 defining the opening 51, a second or inclined portion 75 extending rearwardly and outwardly from the outer end of the forward portion 73, and a third or side portion 77 which extends rearwardly from the rearward end of the second or inclined portion 75. At its rearward end, the rearwardly extending side portion 77 includes an inwardly enlarged part 79 which is received in the recess 53 in the rearward wall 41 defining the opening 51.

Extending partially in the first or transverse portion 73, in the second or outwardly inclined or sloped portion 75, and in the forward part of the third or side portion 77, is a series of horizontally extending water inlet slots 1 which afford entry into the opening 51 of water and which are effective to prevent entry of debris.

The third or side portion 77 of the screen 71 extends as closely as possible in smooth conformity with the convex configuration of the outer side surface 25. above and below the opening 51 so that the screen 71 offers little or no impediment to rearward boundary layer water-flow along the side surface 25 of the gear case 15.

The outer edge 91 defined between the first or transverse forward portion 73 and the second or outwardly inclined or sloped portion 75 is located approximately at the edge 93 defined by the rearward end of the ramp 61 and the forward wall 39 forming the opening 51. Consequently, the slots 81 formed in the screen and extending in the second or outwardly inclined or eloped portion 75 and in the forward part of the third or side portion 77 directly receive cooling water from the water-low running along the surface of the ramp 61. It is also noted that the edge 91 defined between the first or transverse forward portion 73 and the second or outwardly inclined or sloped portion 75 is located laterally inwardly of the inner or inside surface 97 of the forward part of the third or side portion 77. Consequently, water inflowing through the major portion of the slots 81 in the second or outwardly inclined portion 75 passes directly into the opening or passage 51 for flow to the water pump.

Further in this regard, the inwardly enlarged part 79 at the rearward end of the third or side portion 77 of the screen 71 is formed with a corner 101 which, in a horizontal plane, is concavely arcuate and smoothly mergers with the inner surface 97 of the forward part of the third or side portion 77 of the screen 71 and with the non-recessed portion of the rearward wall 41 defining the opening or passage 51. As a consequence, cooling water entering the slots 81 and flowing rearwardly along the inside surface 97 of the third or side portion 77 of the screen 71 is smoothly deflected inwardly along the rearward wall 41 defining the opening or passage 51.

The recess 53 in the rearward wall 41 defining the opening or passage 51 has a lateral depth approximately equal to the lateral thickness of the inwardly enlarged rear part 79 of the third or side portion 77 of the screen 71, with the result that the outer surface of the rear part 79 of the rearwardly extending third or side portion 77 of the screen 71 merges smoothly with the outer surface 25 of the gear case 15 and, hence, any interruption of smooth rearward boundary water-flow past the screen 71 is minimized.

It is noted further that the first or forward transverse portion 73 of the screen 71 is slightly slanted rearwardly, as is the forward wall 39 defining the opening or passage 51, with the result that inward displacement of the screen 71 into the opening 51 serves to cam the rearwardly extending third or side portion 77 of the screen 71 against the rear wall of the recess 53 in the rearward wall 41 forming the opening or passage 51, with the result that both the first or forward transverse portion extends in tight engagement with the forward wall 39 defining the opening or passage 51, and the third or side portion 77 extends in tight engagement with the rear wall of the recess 53, thus minimizing discontinuities between the ramp surface and the screen 71 and between the screen and the portions of the outer surface 25 above, below, and rearwardly of the opening 51, and thereby further minimizing opportunity for interruption of smooth boundary layer water-flow along the side surface 25 of the gear case 15.

The edge 96 connecting the second or outwardly inclined portion 75 of the screen 71 with the third or side portion 77, as well as the outer surface 78 of the side portion 77, extend, as already indicated, as a continuation of the portions of the side surface 25 above, below, and rearwardly the opening or passage 51, thereby minimizing opportunity for interruption of smooth boundary layer water-flow along the side surface 25 of the gear case 15.

Any suitable means can be employed for fixedly attaching the screens 71 to the gear case 15.

Thus, in the disclosed construction, the screens 71 are connected to each other and to the gear case 15 by lower and upper screws 101 and 102 which are preferably self tapping. In this regard, each screen 71 includes, on the inside thereof, two bosses 103 and 105. The boss 103 includes a through bore 107 and the boss 105 includes a blind bore 109 open from the inside. In addition, the gear case includes upper and lower transverse bores 111, only one of which is shown.

Figure 2:
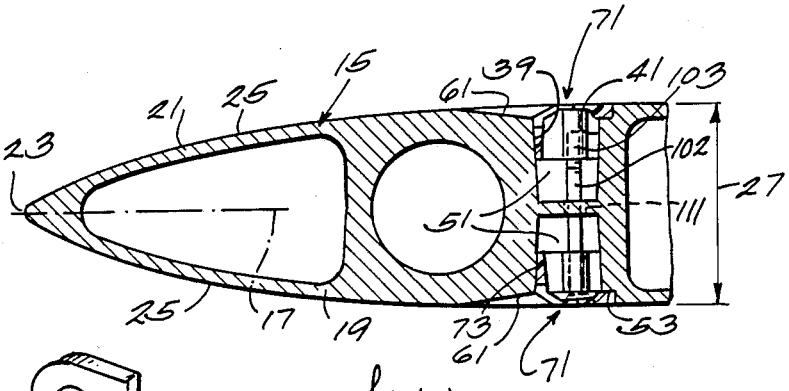
FIG. 2 is an enlarged fragmentary sectional vi along line 2—2 in FIG. 1.
Figure 4:
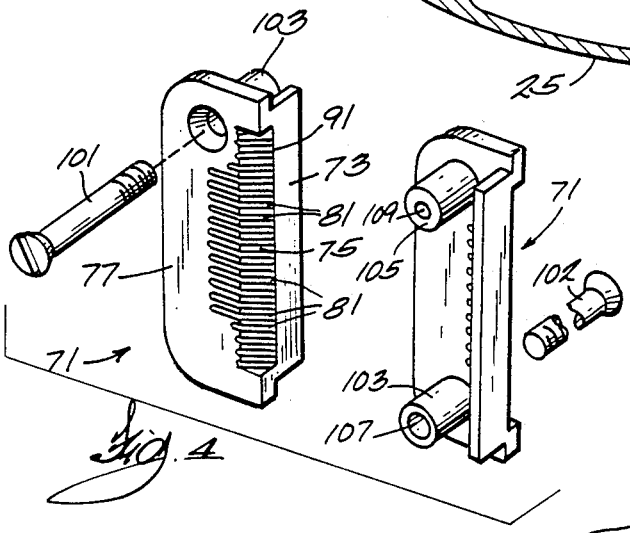
FIG. 4 is an exploded perspective view of four of the components incorporated in the gear case shown in FIG. 1 and with the components rotated 180° about a vertical axis.
Figure 3:
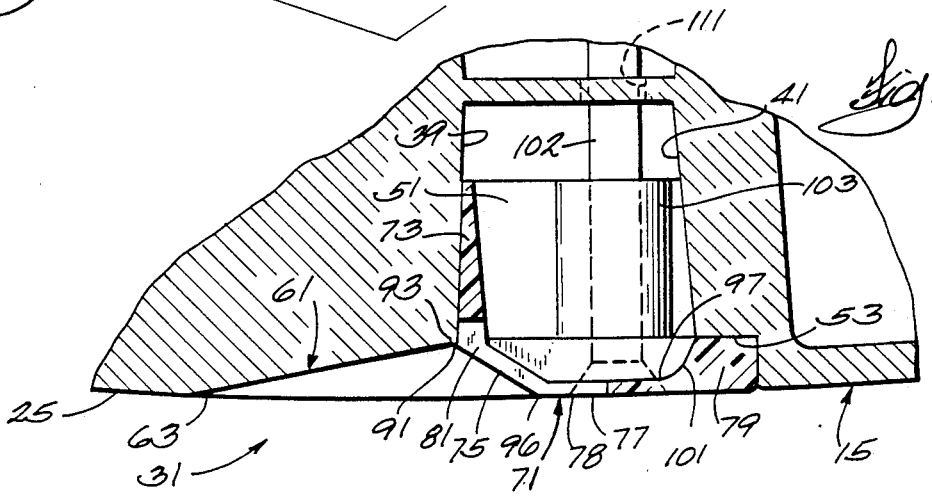
FIG. 3 is a fragmentary enlarged view of a portion of the view shown in FIG. 2.

In assembly, the screens 71 are inserted into the openings 51 with the result that on one side, i.e., the side which is shown in FIG. 1 and which corresponds to the bottom side in FIG. 2, the screen 71 is positioned so that the boss 103 with the through bore 107 is located at the bottom and the boss 105 with the blind bore 109 is located at the top end. On the other side, i.e., the side at the top as shown in FIG. 2, the screen 71 is positioned so that the boss 103 with the through bore 107 is located at the top and the boss 105 with the blind bore 109 is located at the bottom. The lower screw 101 is then inserted through the bore 103 in the screen 71 shown at the bottom as seen in FIG. 2, through the lower transverse bore 111, and is threaded into the blind bore 109 on the other screen 71 shown at the top as seen in FIG. 2. The other or upper screw 102 is inserted through the bore 107 in the boss 103 in the screen 71 shown at the top as seen in FIG. 2, through the other or upper transverse bore in the gear case 15, and is threaded into the blind bore 109 on the screen 71 located at the bottom as seen in FIG. 2.

It is noted that the screens 71 located in each of the openings 51 on the opposite sides of the gear case 15 are identical.

The disclosed screened water inlets effectively shed weeds and provide water to the water pump with a positive head during high speed operation.

Various of the features of the invention are set forth in the following claims.

We claim:

1. A marine propulsion device comprising a lower unit including a gear case rotatably supporting a propeller shaft adapted to support a propeller, said gear case including an interior passage leading to a water pump, said gear case also including a leading ad ge and opposite side surfaces having outwardly convex configurations extending rearwardly from said leading edge, one of said side surfaces including a cooling water inlet comprising means defining an opening located in said one side surface, communicating with said interior passage, and having forward and rearward walls, a recess located in said one side surface forwardly of said opening and having a rearward end located at said forward wall of said opening and a forward end, said recess increasing in lateral depth from said forward end to said rearward end, and a screen located in said opening and including an inclined portion extending outwardly and rearwardly from said forward wall of said opening, and a side portion extending rearwardly from said inclined portion to said rearward wall of said opening, said screen also including a series of horizontal parallel slots respectively having forward ends located in said inclined portion, having rearward ends located in said side portion, extending continuously form said forward ends to said rearward ends, and affording inflow of cooling water to said passage.

2. A marine propulsion device comprising a lower unit including a gear case rotatably supporting a propeller shaft adapted to support a propeller, said gear case including an interior passage leading to a water pump, said gear case also including a leading edge and opposite side surfaces having outwardly convex configurations extending rearwardly form said leading edge, one of said side surfaces including a cooling water inlet comprising means defining an opening located in said one side surface, communicating with said interior passage, and having forward and rearward walls, a recess located in said one side surface forwardly of said opening and having a rearward end located at said forward wall of said opening and a forward end, said recess increasing in lateral depth from said forward end to said rearward end, and a screen located in said opening and including an inclined portion extending outwardly and rearwardly form said forward wall of said opening, and a side portion extending rearwardly from said inclined portion to said rearward wall of said opening, said screen also including a series of horizontal parallel slots each extending in both said inclined and side portions and affording inflow of cooling water to said passage, said slots having a forward end, and said side portion having an inner surface located in laterally outward relation to said forward end of said slots.

3. A marine propulsion device comprising a lower unit including a gear case rotatably supporting a propeller shaft adapted to support a propeller, said gear case including an interior passage leading to a water pump, said gear case also including a leading edge and opposite side surfaces having outwardly convex configurations extending rearwardly from said leading edge, one of said side surfaces including a cooling water inlet comprising means defining an opening located in said one side surface, communicating with said interior passage, and having forward and rearward walls, a recess located in said one side surface forwardly of said opening and having a rearward end located at said forward wall of said opening and a forward end, said recess increasing in lateral depth from said forward end to said rearward end, and a screen located in said opening and including an inclined portion extending outwardly and rearwardly from said forward wall of said opening, and a side portion extending rearwardly from said inclined portion to said rearward wall of said opening, said screen also including a series of horizontal parallel slots located in said inclined and side portions and affording inflow of cooling water to said passage, said side portion including an enlarged rearward end including an inner corner which is inwardly concave in cross section in a horizontal plane, whereby to deflect inwardly cooling water inflowing through said slots.

4. A marine propulsion device in accordance with claim 1 wherein said side surfaces include portions at a maximum spacing from each other, and wherein said opening is located forwardly of said side surface portions.

5. A marine propulsion device in accordance with claim 1 wherein said inclined portion has a forward end, and wherein said screen includes a transversely extending forward portion extending inwardly of said opening from the forward end of said inclined portion.

6. A screen for a water inlet opening in an outer side surface of a gear case included in a marine propulsion device, which opening has forward and rearward walls, said screen being adapted to be located in the opening and comprising a first portion having one end adapted to extend outwardly and rearwardly form the forward wall of the opening, and having an other end, said screen also comprising a second portion extending from said other end of said first portion and at an obtuse angle thereto and adapted to extend to the rearward wall of the opening, said screen also comprising a series of horizontal parallel slots respectively having forward ends located in said first portion, having rearward ends located in said second portion, extending continuously from said forward ends to said rearward ends, and affording inflow of cooling water into the opening.

7. A screen for a water inlet opening in an outer side surface of a gear case included in a marine propulsion device, which opening has forward and rearward walls, said screen being adapted to be located in the opening and comprising a first portion having one end adapted to extend outwardly and rearwardly from the forward wall of the opening, and having an other end, said screen also comprising a second portion extending from said other end of said first portion and at an obtuse angle thereto and adapted to extend to the rearward wall of the opening, said screen also comprising a series of horizontal parallel slots each extending in both said first and second portions and affording inflow of cooling water into the opening, said slots having a forward end, and said second portion having an inner surface located in laterally outward relation to said forward end of said slots.

8. A screen for a water inlet opening in an outer side surface of a gear case included in a marine propulsion device, which opening has forward and rearward walls, said screen being adapted to be located in the opening and comprising a first portion having one end adapted to extend outwardly and rearwardly from the forward wall of the opening, and having an other end, said screen also comprising a second portion extending from said other end of said first portion and at an obtuse angle thereto and adapted to extend to the rearward wall of the opening, said screen also comprising a series of horizontal parallel slots located in said first and second portions and affording inflow of cooling water into the opening, said second portion including an enlarged rearward end including an inner corner which is inwardly concave in cross section in a plane parallel to said slots to deflect inwardly cooling water inflowing through said slots.

9. A screen in accordance with claim 6 wherein said first portion has a forward end, and wherein said screen also comprises a transversely extending third portion adapted to extend inwardly of the opening from said forward end of said first portion.

* * * * *